US009936302B2

(12) United States Patent
Linghu et al.

(10) Patent No.: US 9,936,302 B2
(45) Date of Patent: Apr. 3, 2018

(54) MINIATURE SOUNDER

(71) Applicants: Ronglin Linghu, Shenzhen (CN); Bo Xiao, Shenzhen (CN)

(72) Inventors: Ronglin Linghu, Shenzhen (CN); Bo Xiao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/417,130

(22) Filed: Jan. 26, 2017

(65) Prior Publication Data

US 2017/0347201 A1 Nov. 30, 2017

(30) Foreign Application Priority Data

May 26, 2016 (CN) ..... 2016 2 0490780 U

(51) Int. Cl.

| | |
|---|---|
| ***H04R 1/00*** | (2006.01) |
| ***H04R 9/06*** | (2006.01) |
| ***H04R 9/02*** | (2006.01) |
| ***H04R 7/18*** | (2006.01) |
| ***H04R 7/14*** | (2006.01) |

(52) U.S. Cl.

CPC ..... *H04R 9/06* (2013.01); *H04R 7/14* (2013.01); *H04R 7/18* (2013.01); *H04R 9/025* (2013.01)

(58) Field of Classification Search

CPC combination set(s) only.
See application file for complete search history.

(56) References Cited

U.S. PATENT DOCUMENTS 8,542,861 B2 * 9/2013 Saiki ..... H04R 7/20 181/166

* cited by examiner

*Primary Examiner* — Amir Etesam
(74) *Attorney, Agent, or Firm* — Na Xu; IPro, PLLC

(57) ABSTRACT

Some embodiments of the present invention provide miniature sounder which includes a frame and a vibration system and a magnetic path system fixedly connected to the frame. The magnetic path system includes a lower clamping board, a primary magnet disposed on the lower clamping board, secondary magnets disposed on the lower clamping board and arranged around the primary magnet, and a cushion provided on the lower clamping board and located outside the secondary magnets, a gap being provided between two adjacent secondary magnets. The vibration system includes a voice diaphragm, a voice coil which drives the voice diaphragm to vibrate and generate a sound, and a vibrating diaphragm which elastically supports the voice coil. The vibrating diaphragm includes a first connecting portion connected to the voice coil, a second connecting portion connected to the cushion, and a corrugated rim connecting the first connecting portion and the second connecting portion.

5 Claims, 3 Drawing Sheets

MINIATURE SOUNDER

TECHNICAL FIELD

The present invention relates to the field of electro-acoustic conversion, and specifically, to a miniature sounder.

BACKGROUND

In recent years, with the development of science and technology, especially the rapid development of mobile communication technology, more and more mobile electronic devices appear in people's daily life. For example, smart phones, tablet computers, laptops, and multi-function media players have become indispensable to people's daily necessities. Moreover, a voice playback device is an essential component in the mobile electronic devices. Voice quality directly affects experience of users when using the mobile electronic devices.

For a miniature sounder as a voice playback device, its structural design directly affects the voice quality. A miniature sounder in the related art includes a voice diaphragm and a voice coil which drives the voice diaphragm to vibrate and generate a sound. Because the voice coil is only glued to the voice diaphragm and lacks effective support, the voice coil is prone to swing during the vibration process and affect the sound quality.

Therefore, it is desired to provide a novel miniature sounder, so as to solve the above-mentioned technical problem.

SUMMARY

Some embodiments of the present invention aim to provide a miniature sounder capable of solving the voice coil swing problem.

The objective of an embodiment of the present invention is realized as follows:

A miniature sounder includes a frame and a vibration system and a magnetic path system fixedly connected to the frame, where the magnetic path system includes a lower clamping board, a primary magnet disposed on the lower clamping board, secondary magnets disposed on the lower clamping board and arranged around the primary magnet, and a cushion provided on the lower clamping board and located outside the secondary magnets, a gap being provided between two adjacent secondary magnets; and the vibration system includes a voice diaphragm, a voice coil which is located below the voice diaphragm and drives the voice diaphragm to vibrate and generate a sound, and a vibrating diaphragm which elastically supports the voice coil, where the vibrating diaphragm includes a first connecting portion connected to the voice coil, a second connecting portion connected to the cushion, and a corrugated rim connecting the first connecting portion and the second connecting portion, the corrugated rim is disposed in the gap, and the corrugated rim includes successively a first protrusion, a second protrusion, and a third protrusion, the second protrusion being located between the first protrusion and the third protrusion, and a protruding direction of the first protrusion being the same as that of the third protrusion and being opposite to that of the second protrusion.

In one embodiment, the secondary magnets are each provided with an extended portion extending to a position over the cushion, and the second connecting portion is sandwiched between the cushion and the extended portion.

In one embodiment, the secondary magnets include a first secondary magnet connected to the lower clamping board and a second secondary magnet superimposed on the first secondary magnet, the second secondary magnet extends to a position over the cushion, and the second connecting portion is sandwiched between the cushion and the second secondary magnet.

In one embodiment, the cushion is made of a magnetically permeable material.

In one embodiment, the cushion is formed by extending from the lower clamping board and constructs an integral structure with the lower clamping board.

Some embodiments of the present invention have the beneficial effects that: the miniature sounder provided in the present invention is provided with a corrugated rim in a wave-like shape, and by means of elastic support of the voice coil by the vibrating diaphragm, the voice coil swing problem of the miniature sounder is resolved, the sound quality is improved, and the maximum low frequency output sound pressure of the miniature sounder is improved.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention. Embodiments of the invention are described, by way of example only, with reference to the accompanying drawings, in which.

Figure 1:
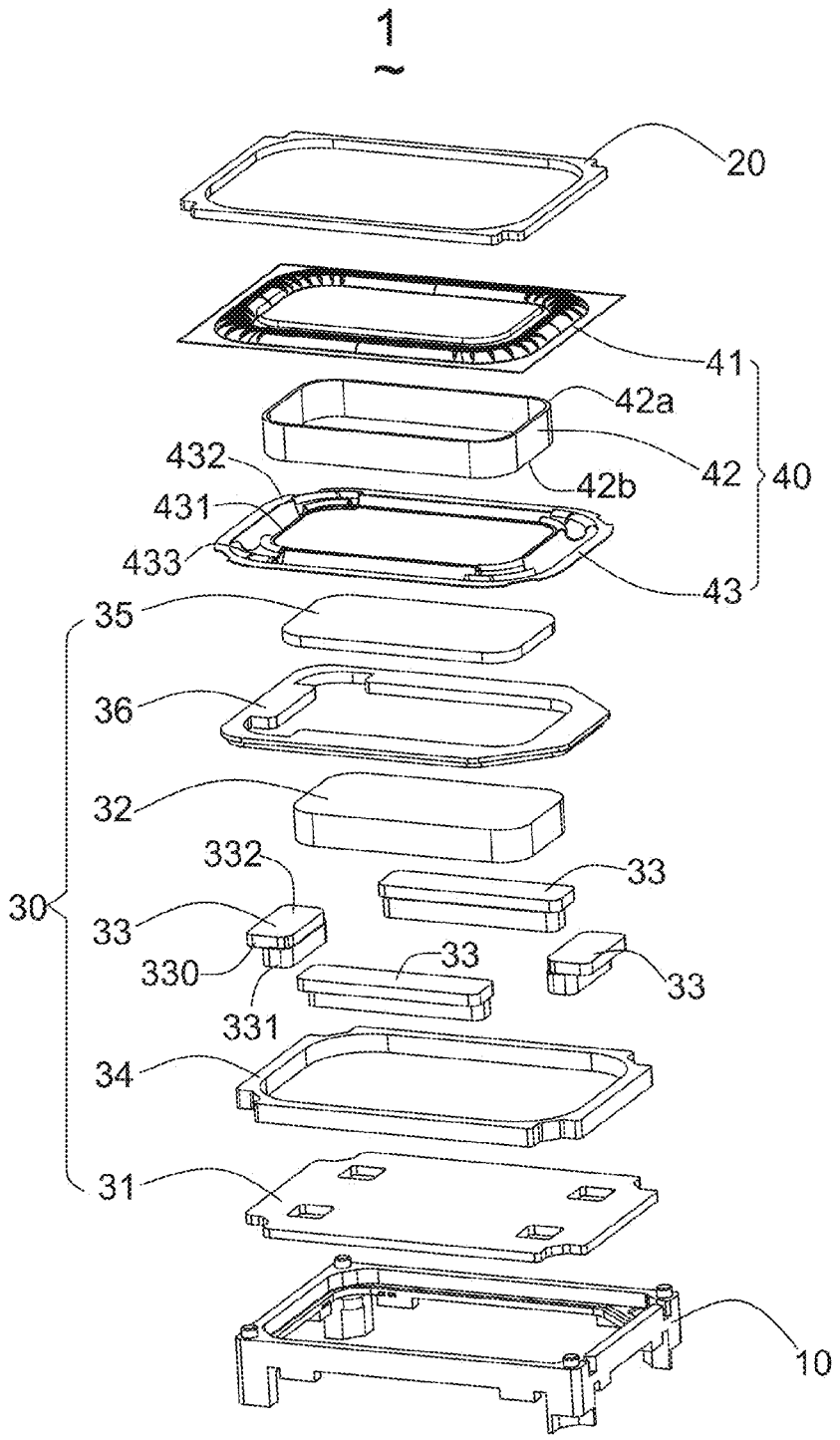
FIG. 1 is a isometric exploded view of a miniature sounder according to some embodiments in the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

This specification discloses one or more embodiments that incorporate the features of this invention. The disclosed embodiment(s) merely exemplify the invention. The scope of the invention is not limited to the disclosed embodiment (s). The invention is defined by the claims appended hereto.

The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

The present invention is described in detail with reference to the accompanying drawings.

Figure 2:
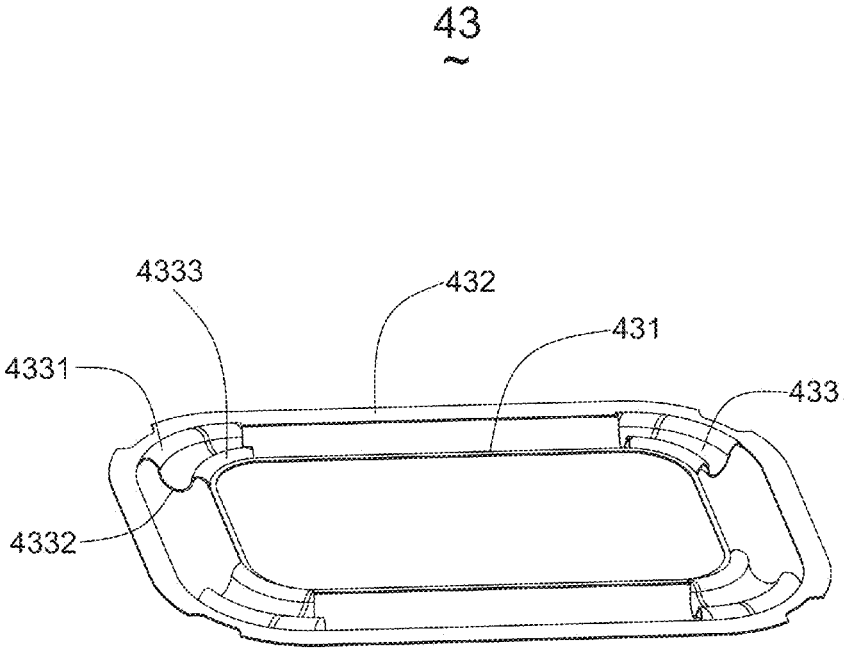
FIG. 2 is a three-dimensional structural diagram of a vibrating diaphragm of a miniature sounder according to some embodiments in the present invention.
Figure 3:
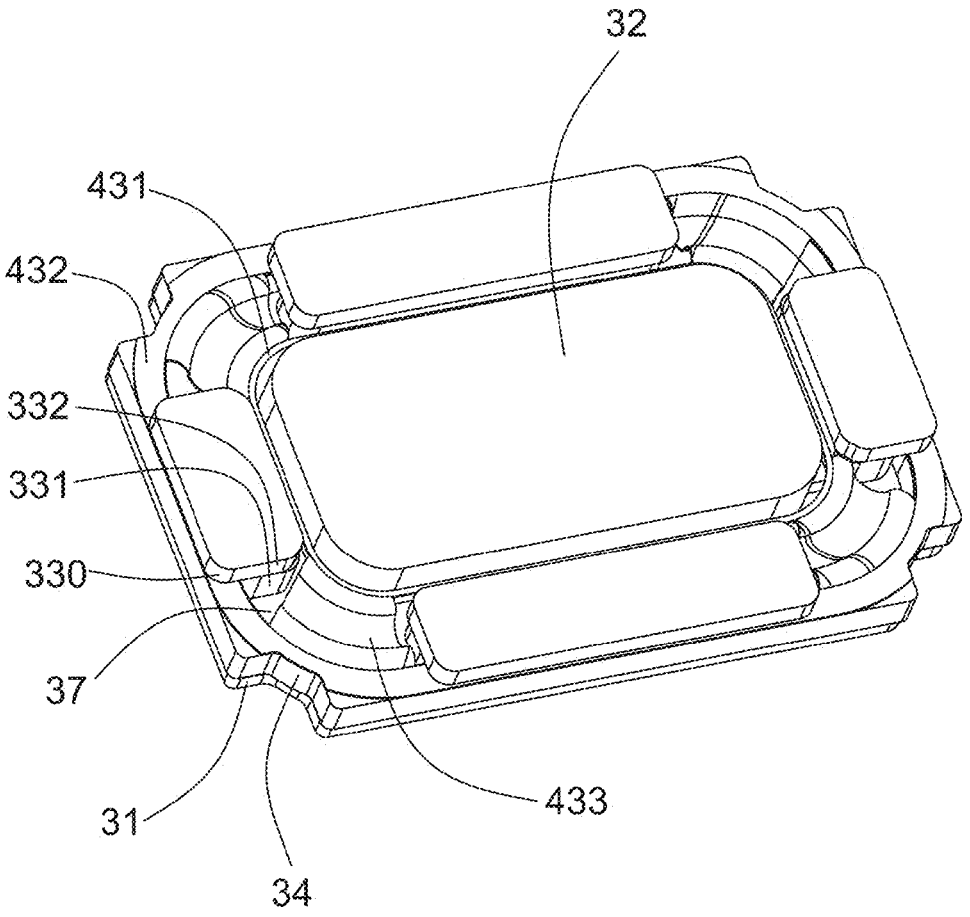
FIG. 3 is a schematic diagram showing a combination of a lower clamping board, a primary magnet, secondary magnets, a cushion, and a vibrating diaphragm of a miniature sounder according to some embodiments in the present invention.

As shown in FIG. 1 to FIG. 3, a miniature sounder 1 provided in some embodiments of the present invention includes a frame 10, a front cover 20 connected to the frame 10 in a covering manner, and a magnetic path system 30 and a vibration system 40 fixedly connected to the frame 10.

The magnetic path system 30 includes a lower clamping board 31, a primary magnet 32 disposed on the lower clamping board 31, secondary magnets 33 disposed on the lower clamping board 31 and arranged around the primary magnet 32, and a cushion 34 provided on the lower clamping board 31 and located outside the secondary magnets 33. The cushion 34 is a closed loop structure. The magnetic path system 30 further includes a pole core 35 attached to the primary magnet 32 and a pole core 36 attached to the secondary magnets 33. A gap 37 is provided between two adjacent secondary magnets 33.

The vibration system 40 includes a voice diaphragm 41, a voice coil 42 which is located below the voice diaphragm 41 and drives the voice diaphragm 41 to vibrate and generate a sound, and a vibrating diaphragm 43 which elastically supports the voice coil 42. The vibrating diaphragm 43 includes a first connecting portion 431 connected to the voice coil 42, a second connecting portion 432 connected to the cushion 34, and a corrugated rim 433 connecting the first connecting portion 431 and the second connecting portion 432. The corrugated rim 433 is provided in the gap 37 and presents a wave-like structure. Specifically, the corrugated rim 433 includes successively a first protrusion 4331, a second protrusion 4332, and a third protrusion 4333, the second protrusion 4332 is located between the first protrusion 4331 and the third protrusion 4333, and a protruding direction of the first protrusion 4331 is the same as that of the third protrusion 4333 and is opposite to that of the second protrusion 4332.

In an embodiment, the first connecting portion 431 is fixed to a lower end portion 42*b* of the voice coil 42, and an upper end portion 42*a* of the voice coil 42 is connected to the voice diaphragm 41.

The cushion 34 may be made of a magnetically permeable material for conducting a magnetic field, and certainly may also be made of a conventional non-magnetically permeable material, as long as the objective of providing a vibration space for the vibrating diaphragm 43 to vibrate by elevating the vibrating diaphragm 43 can be achieved. In this embodiment, the cushion 34 and the lower clamping board 31 are provided separately. Certainly, the cushion 34 may also be formed by extending from the lower clamping board 31 and construct an integral structure with the lower clamping board 31.

The secondary magnets 33 are each provided with an extended portion 330 which extends to a position over the cushion 34, and the second connecting portion 432 is sandwiched between the cushion 34 and the extended portion 330, thereby being capable of ensuring stable connection of the vibrating diaphragm 43.

In an embodiment, the secondary magnets 33 include a first secondary magnet 331 connected to the lower clamping board 31 and a second secondary magnet 332 superimposed on the first secondary magnet 331. The second secondary magnet 332 extends to a position over the cushion 34 (equivalent to forming the extended portion 330 described above). The second connecting portion 432 is sandwiched between the cushion 34 and the second secondary magnet 332.

The miniature sounder provided in the present invention is provided with a vibrating diaphragm in a wave-like shape, and by means of elastic support of the voice coil by the vibrating diaphragm, the voice coil swing problem of the miniature sounder is resolved, the sound quality is improved, and the maximum low frequency output sound pressure of the miniature sounder is improved.

The above descriptions are only implementation manners of the present invention, and it should be noted that a person skilled in the art may further make improvements therefore without departing from the inventive concept of the present invention. However, these improvements fall within the protection scope of the present invention.

What is claimed is:

1. A miniature sounder, comprising:

a frame and a vibration system and a magnetic path system fixedly connected to the frame;

wherein the magnetic path system comprises a lower clamping board, a primary magnet disposed on the lower clamping board, secondary magnets disposed on the lower clamping board and arranged around the primary magnet, and a cushion provided on the lower clamping board and located outside the secondary magnets, a gap being provided between two adjacent secondary magnets;

wherein the vibration system comprises a voice diaphragm, a voice coil which is located below the voice diaphragm and drives the voice diaphragm to vibrate and generate a sound, and a vibrating diaphragm which elastically supports the voice coil;

wherein the vibrating diaphragm comprises a first connecting portion connected to the voice coil, a second connecting portion connected to the cushion, and a corrugated rim connecting the first connecting portion and the second connecting portion;

wherein the corrugated rim is disposed in the gap, and the corrugated rim comprises successively a first protrusion, a second protrusion, and a third protrusion, the second protrusion being located between the first protrusion and the third protrusion, and a protruding direction of the first protrusion being the same as that of the third protrusion and being opposite to that of the second protrusion.

2. The miniature sounder according to claim 1, wherein the secondary magnets are each provided with an extended portion extending to a position over the cushion, and the second connecting portion is sandwiched between the cushion and the extended portion.

3. The miniature sounder according to claim 1, wherein the secondary magnets comprise a first secondary magnet connected to the lower clamping board and a second secondary magnet superimposed on the first secondary magnet, the second secondary magnet extends to a position over the cushion, and the second connecting portion is sandwiched between the cushion and the second secondary magnet.

4. The miniature sounder according to claim 1, wherein the cushion is made of a magnetically permeable material.

5. The miniature sounder according to claim 1, wherein the cushion is formed by extending from the lower clamping board and constructs an integral structure with the lower clamping board.

* * * * *